US009947278B2

(12) United States Patent
Li et al.

(10) Patent No.: US 9,947,278 B2
(45) Date of Patent: Apr. 17, 2018

(54) DISPLAY METHOD AND DEVICE AND COMPUTER-READABLE MEDIUM

(71) Applicant: Xiaomi Inc., Beijing (CN)

(72) Inventors: Guosheng Li, Beijing (CN); Anyu Liu, Beijing (CN); Dongdong Yang, Beijing (CN)

(73) Assignee: XIAOMI INC., Haidian District, Beijing (CN)

( * ) Notice: Subject to any disclaimer, the term of this patent is extended or adjusted under 35 U.S.C. 154(b) by 112 days.

(21) Appl. No.: 15/068,635

(22) Filed: Mar. 13, 2016

(65) Prior Publication Data

US 2017/0116939 A1 Apr. 27, 2017

(30) Foreign Application Priority Data

Oct. 22, 2015 (CN) ..... 2015 1 0696526

(51) Int. Cl.
*G09G 3/36* (2006.01)
*G09G 3/20* (2006.01)

(52) U.S. Cl.
CPC ..... *G09G 3/3648* (2013.01); *G09G 3/20* (2013.01); *G09G 2310/0213* (2013.01);
(Continued)

(58) Field of Classification Search
CPC ... G06T 1/60; G09G 5/36; G09G 5/39; G09G 3/36; G11C 19/00; G02F 1/1345
See application file for complete search history.

(56) References Cited

U.S. PATENT DOCUMENTS 8,139,433 B2 3/2012 Sewall et al.
2007/0200839 A1 8/2007 Sampsell
(Continued)

FOREIGN PATENT DOCUMENTS

CN 1984115 A 6/2007
CN 102124435 A 7/2011
(Continued)

OTHER PUBLICATIONS

Extended European Search Report of EP16164078.4.
First Office Action of EP16164078.4.
International Search Report of PCT/CN2015/098950.
First Office Action of EP16161078.4.

*Primary Examiner* — Pegeman Karimi
(74) *Attorney, Agent, or Firm* — Jun He Law Offices P.C.; James J. Zhu

(57) ABSTRACT

A display method, device and a computer-readable medium are provided. The method includes: detecting whether there is any change in a displayed content for the display; in response to detecting that the displayed content for the display does not change, controlling the display to alternately update display data corresponding to a first portion and a second portion of display units in each row when the display unit comprises m rows of pixels; and in response to detecting that the displayed content for the display does not change, controlling the display to alternately update display data corresponding to a third portion and a fourth portion of display units in each column when the display unit comprises n columns of pixels. Herein m and n are positive integers. Thus, screen flicker caused by reduction of refresh frequency of a display while the display content does not change can be avoided.

13 Claims, 17 Drawing Sheets

(52) U.S. Cl.
CPC . *G09G 2310/0227* (2013.01); *G09G 2310/04* (2013.01); *G09G 2320/0247* (2013.01); *G09G 2320/103* (2013.01); *G09G 2330/021* (2013.01); *G09G 2340/0435* (2013.01)

(56) References Cited

U.S. PATENT DOCUMENTS

| | | | | |
|---|---|---|---|---|
| 2011/0175883 | A1* | 7/2011 | Toyotaka | G09G 3/3648 345/211 |
| 2012/0249615 | A1 | 10/2012 | Lee | |
| 2012/0299958 | A1 | 11/2012 | Tsurumi | |
| 2013/0057565 | A1* | 3/2013 | Choi | G09G 3/2096 345/547 |
| 2013/0088479 | A1 | 4/2013 | Kim et al. | |
| 2015/0035819 | A1* | 2/2015 | Kim | G09G 3/3618 345/213 |

FOREIGN PATENT DOCUMENTS

| | | | |
|---|---|---|---|
| CN | 103561308 | A | 2/2014 |
| CN | 104077183 | A | 10/2014 |
| JP | 2001184034 | A | 7/2001 |
| KR | 20120110413 | A | 10/2012 |
| KR | 20130027226 | A | 3/2013 |
| KR | 20130039077 | A | 4/2013 |
| RU | 2368006 | C1 | 9/2009 |
| RU | 2507549 | C2 | 2/2014 |

* cited by examiner

DISPLAY METHOD AND DEVICE AND COMPUTER-READABLE MEDIUM

CROSS-REFERENCE TO RELATED APPLICATION

This application claims priority to Chinese Patent Application No. 201510696526.2, filed on Oct. 22, 2015, which is incorporated herein by reference in its entirety.

TECHNICAL FIELD

The present disclosure generally relates to the field of image processing, and more particularly, to a display method and device and computer-readable medium.

BACKGROUND

The power consumption of a display, which takes up a large portion of power consumption of a smart device, significantly affects battery lifetime of the smart device. Traditionally, reduction of power consumption of a display is achieved by reducing refresh frequency of the display. However, reduction of refresh frequency of the display will result in screen flicker.

SUMMARY

According to a first aspect of the present disclosure, there is provided a display method for use in a device configured with a display. The method includes: detecting whether there is any change in a displayed content for the display; in response to detecting that the displayed content for the display does not change, controlling the display to alternately update display data corresponding to a first portion and a second portion of display units in each row when the display unit comprises m rows of pixels; and in response to detecting that the displayed content for the display does not change, controlling the display to alternately update display data corresponding to a third portion and a fourth portion of display units in each column when the display unit comprises n columns of pixels, wherein m and n are positive integers.

According to a second aspect of the present disclosure, there is provided a device, including: a display; a processor; and a memory to store instructions executable by the processor; wherein the processor is configured to: detect whether there is any change in a displayed content for the display; in response to detecting that the displayed content for the display does not change, control the display to alternately update display data corresponding to a first portion and a second portion of display units in each row when the display unit comprises m rows of pixels; and in response to detecting that the displayed content for the display does not change, control the display to alternately update display data corresponding to a third portion and a fourth portion of display units in each column when the display unit comprises n columns of pixels, wherein m and n are positive integers.

According to a third aspect of the present disclosure, there is provided a non-transitory computer-readable storage medium having stored therein instructions that, when executed by a processor of a device configured with a display, causes the device to perform a display method. The method includes: detecting whether there is any change in a displayed content for the display; in response to detecting that the displayed content for the display does not change, controlling the display to alternately update display data corresponding to a first portion and a second portion of display units in each row when the display unit comprises m rows of pixels; and in response to detecting that the displayed content for the display does not change, controlling the display to alternately update display data corresponding to a third portion and a fourth portion of display units in each column when the display unit comprises n columns of pixels, wherein m and n are positive integers.

It is to be understood that both the foregoing general description and the following detailed description are exemplary and explanatory only and are not restrictive of the disclosure, as claimed.

BRIEF DESCRIPTION OF THE DRAWINGS

The accompanying drawings, which are incorporated in and constitute a part of this specification, illustrate embodiments consistent with the disclosure and, together with the description, serve to explain the principles of the disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the disclosure. Instead, they are merely examples of devices and methods consistent with aspects related to the disclosure as recited in the appended claims.

Display methods provided by various embodiments of the disclosure may be implemented by an electronic device with a display. The electronic device may be a smart phone, a smart television, a tablet computer, an ebook reader, an MP3 (Moving Picture Experts Group Audio Layer III) player, an MP4 (Moving Picture Experts Group Audio Layer IV) player and a laptop computer (camera, vidicon), etc. The displays may employs a LCD (Liquid Crystal Display), a LED (Light Emitting Diode), or an OLED (Organic Light-Emitting Diode), or any other display using pixels for display.

Figure 1:
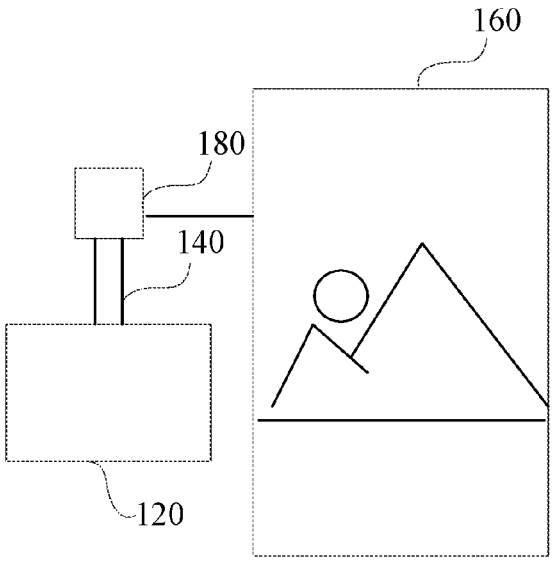
FIG. 1 is a schematic diagram of an implementation environment for a display method according to an exemplary embodiment.

As shown in FIG. 1, a schematic diagram of an implementation environment for the display methods provided by various exemplary embodiments of the disclosure is illustrated. The implementation environment may be an internal environment of an electronic device with a display. The implementation environment may include a processor 120, a transmission bus 140, a display 160 and a driving IC 180 corresponding to the display 160.

The processor 120 may be a CPU (Central Processing Unit) or a GPU (Graphics Processing Unit) configured to generate display data corresponding to display content and to transmit the display data to the driving IC 180 via the transmission bus 140.

The processor 120 and the driving IC 180 may be electrically connected to the transmission bus 140 respectively and transmit the display data via the transmission bus 140.

The driving IC 180 may be used to receive the display data sent by the processor 120 via the transmission bus 140 and to control corresponding pixel units of the display 160 to update the display content according to the display data. The driving IC 180 may be electrically connected with the display 160.

For simplicity of description, a display method which is exemplarily performed by a terminal device is illustrated below, but it is not limited thereto.

Figure 2:
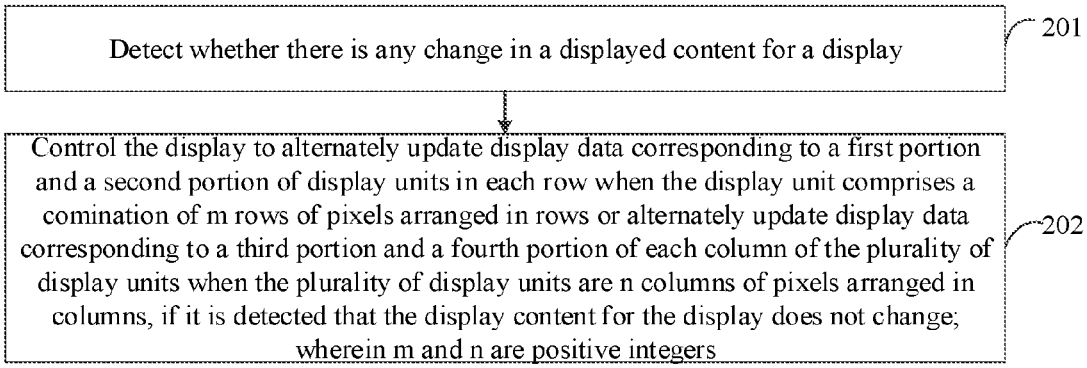
FIG. 2 is a flow chart of a display method according to an exemplary embodiment.

FIG. 2 is a flow chart of a display method according to an exemplary embodiment. As shown in FIG. 2, the display method includes following steps.

In step 201, whether there is any change in a displayed content for a display is detected.

In step 202, if it is detected that the display content for the display does not change, the display is controlled to alternately update display data corresponding to a first portion and a second portion of display units in each row when the display unit is a combination of m rows of pixels. The whole display may be divided into a plurality of display units in rows. Alternatively, the display is controlled to alternately update display data corresponding to a third portion and a fourth portion of display units in each column, when the display unit is a combination of n columns of pixels. The whole display may be divided into a plurality of display units in columns. Herein, m and n are positive integers.

In conclusion, for the display method provided by the disclosure, by detecting whether there is any change in the displayed content for the display and controlling the display to alternately update display data corresponding to the first portion and second portion of display units in each row or alternately update display data corresponding to the third portion and fourth portion of display units in each column if the displayed content does not change, the number of the pixels to be updated by the display in each update can be reduced while maintaining the original refresh frequency, thereby the problem of screen flicker due to the reduction of refresh frequency of a display can be solved. Moreover, the screen flicker can be avoided and power consumption of the display can be reduced while maintaining the original refresh frequency.

Figure 3A:
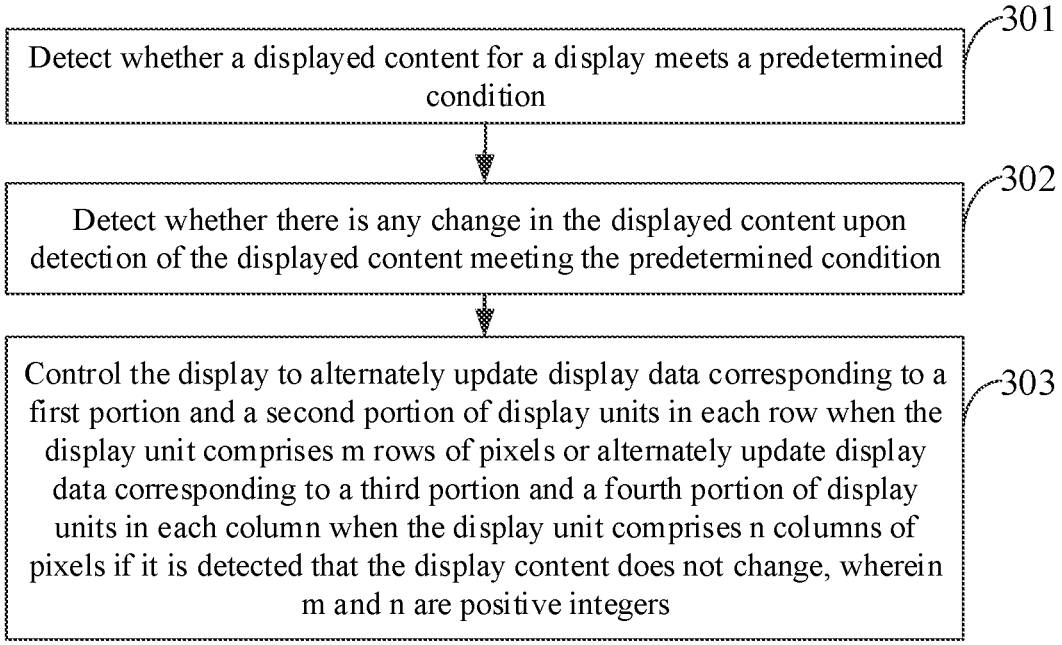
FIG. 3A is a flow chart of a display method according to an exemplary embodiment.

FIG. 3A is a flow chart of a display method according to an exemplary embodiment. As shown in FIG. 3A, the display method may include the following steps.

In step 301, whether a displayed content for a display meets a predetermined condition is detected.

When a display of a terminal device displays contents, display data are required to be sent by a processor to a driving IC corresponding to the display at a predetermined frequency. The driving IC controls the display to display a content to be displayed according to the display data. The processor may be a CPU or a GPU, and the predetermined frequency generally may be 60 Hz. In certain cases, however, the displayed content for the display may remain unchanged within a short period of time. For a display configured with a Random-Access Memory (RAM), the driving IC may read history display data from the RAM when the displayed content remains the same to avoid a waste of resources caused by generation of the same display data by the processor. However, for a display configured without a RAM, the processor is still required to generate the same display data continuously although the displayed content remains unchanged, resulting in a waste of computing resources of the processor.

In order to avoid the waste of computing resources of the processor caused by the generation of the same display data, the terminal device may detect in real time whether the displayed content meets certain predetermined condition. Step 302 is performed when it is detected that the displayed content meets the predetermined condition. The predetermined condition may include at least one of the following: the displayed content being generated by a preset application, a required frames per second (FPS) by the displayed content being lower than a preset FPS threshold.

The preset application may be an application such as an ebook, a picture browser or the like. The displayed content generated by such application generally is a generally static image which remains unchanged within a period of time.

Additionally, the preset FPS threshold may be a default refresh frequency of the display. That is, when the displayed content includes dynamic pictures but the FPS is smaller than the refresh frequency of the display, the displayed content also meets the predetermined condition. For example, if the displayed content is a video with an FPS of 24 frames/second and the refresh frequency of the display is 60 Hz (that is 60 frames/second), the displayed content meets the predetermined condition as well.

In step 302, if it is detected that the displayed content meets the predetermined condition, whether there is any change in the displayed content for the display is further detected.

Upon detection of the displayed content meeting the predetermined condition, the terminal device detects whether there is any change in the displayed content. If there is any change in the displayed content, the terminal device generates complete display data corresponding to the displayed content. If there is no change in the displayed content, step 303 is performed.

As an alternative implementation, if the displayed content is generated by a preset application, upon receiving a Display Content Change signal triggered by a user, the terminal device determines that the displayed content changes, wherein the Display Content Change signal may be triggered when the user touches the display.

As another alternative implementation, if the FPS required by the displayed content is smaller than the preset FPS threshold, the terminal device determines a variation period variation period of the displayed content according to the FPS required by the displayed content and the refresh frequency of the display, and detects whether there is any change in the displayed content according to the variation period. For example, if the FPS required by the displayed content is 15 frames/second and the refresh frequency of the display is 60 Hz (i.e., 60 frames/second), then the variation period of the displayed content is 4 frames. That is, the display changes changes once for every 4 frames refreshed by the display.

In step 303, the display is controlled to alternately update display data corresponding to a first portion and a second portion of all of the row display units of the display if it is detected that the displayed content does not change, wherein each of the row display units are a combination of m rows of pixels. Alternatively, the display is controlled to alternately update display data corresponding to a third portion and a fourth portion of all of the column display units of the display if it is detected that the displayed content does not change, wherein each of the column display units are a set combination n columns of pixels. Herein, m and n are positive integers.

When it is detected that the displayed content does not change, the terminal device controls the display to alternately update display data corresponding to the first portion and second portion of all of the row display unit. Since the display (e.g., the liquid crystal in LCDs) is capable of keeping the image displayed thereon for a while, during the time when the display data corresponding to the first portion of the display units is being updated, the displayed content of the second portion will not disappear but become slightly darker, which affects little to the overall display effect of the displayed content, and may not affect the user experience. Similarly, during the time when the display data corresponding to the third portion or the fourth portion of display units is being updated, the overall display effect of the displayed content may not be significantly affected.

In a first alternative implementation, when the row display unit of the display is a combination of m rows of pixels, the first portion of the display unit may include i first cells, and the second portion of the display unit may include j second cells. The first cells may alternate with the second cells. The number i and j may be positive integers. Each of the first cells may include p pixels, and each second cells each may include q pixels, wherein both p and q are positive integers.

When the display unit of the display is a combination of m rows of pixels, the update of the display data corresponding to display units in a row may be divided into N updates and 1/N portion of the row of display units is sequentially updated. For example, when N=2, the update of the display data corresponding to the row display unit is divided into two updates, that is, the first update is conducted with respect to display data corresponding to the first portion of the display units, and the second update is conducted with respect to display data corresponding to the second portion of the display units. Then the first update and the second update are repeated in an alternate manner. When N=3, the update of the display data corresponding to the row display unit is divided into three updates, that is, the first update is conducted with respect to display data corresponding to the first portion of the display units, the second update is conducted with respect to display data corresponding to the second portion of the display unit, and the third update is conducted with respect to display data corresponding to the third portion of the display unit. Then the first update, the second update and the third update are repeatedly in an alternate manner.

It should be noted that, if the refresh frequency of the display is fixed, the greater the value of N is, the more the screen may flicker. For example, supposed that the refresh frequency of the display is 60 Hz, when N=2, the update frequency of display data corresponding to each portion of the display units is 30 Hz; when N=3, the update frequency of display data corresponding to each portion of the display units is 20 Hz. The lower the update frequency of display data corresponding to each portion of the display units is, the more the screen may flicker.

In order to mitigate the phenomenon of screen flicker, in an alternative scenario, the refresh frequency of the display is kept unchanged and N is set to be a smaller value, e.g., N is set to be 2. The update frequency of the display data corresponding to each portion of the display units is 30 Hz. In another alternative scenario, the original refresh frequency increases and N is set to be a larger value, e.g., the refresh frequency changes from 60 Hz to 90 Hz and N is set to be 3. The update frequency of display data corresponding to each portion of the display unit is also 30 Hz.

When display units in a row are divided into a first portion of display units and a second portion of display units, any number of pixels may be selected from the display units in the row as the first portion of display units, and the remaining pixels of the display units serve as the second portion of display units. The number of pixels included in the first portion of display unit may be the same as or different from the number of pixels included in the second portion of display unit. For example, if display units in a row are a row of pixels which includes 1920 pixels, 960 pixels of the 1920 pixels may serve as the first portion of the display units and the remaining 960 pixels may serve as the second portion of the display units.

A plurality of successive pixels may be selected as the first portion of the display unit. For example, the first 960 pixels of a row of 1920 pixels may form the first portion of the display units and the last 960 pixels of the row of 1920 pixels may form the second portion of the display units. Alternatively, the middle 960 pixels of a row of 1920 pixels may form the first portion of the display units and the remaining 960 pixels may form the second portion of the display units.

Figure 3B:
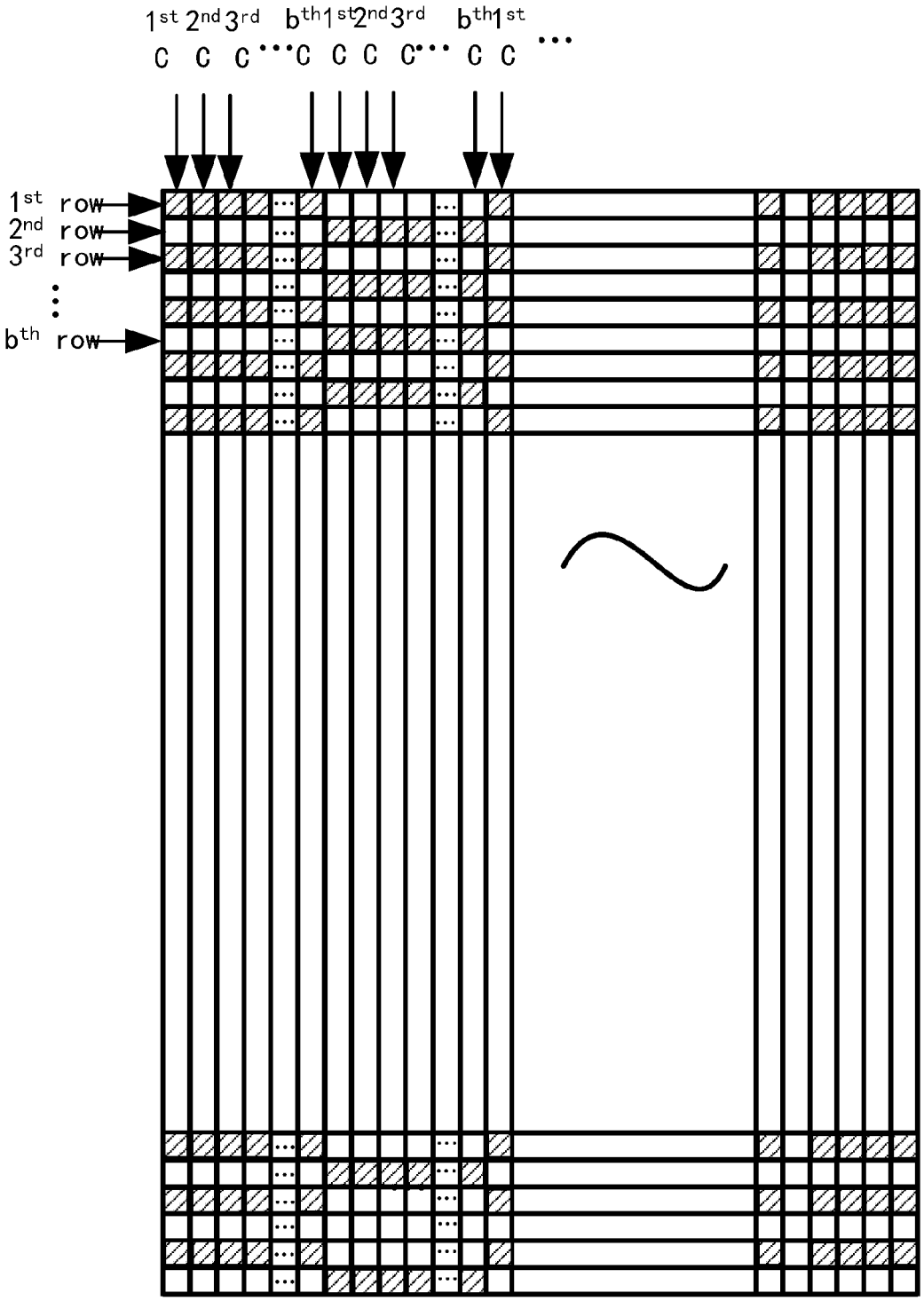
FIG. 3B is a schematic diagram illustrating a first type of display updating according to an exemplary embodiment.
Figure 3C:
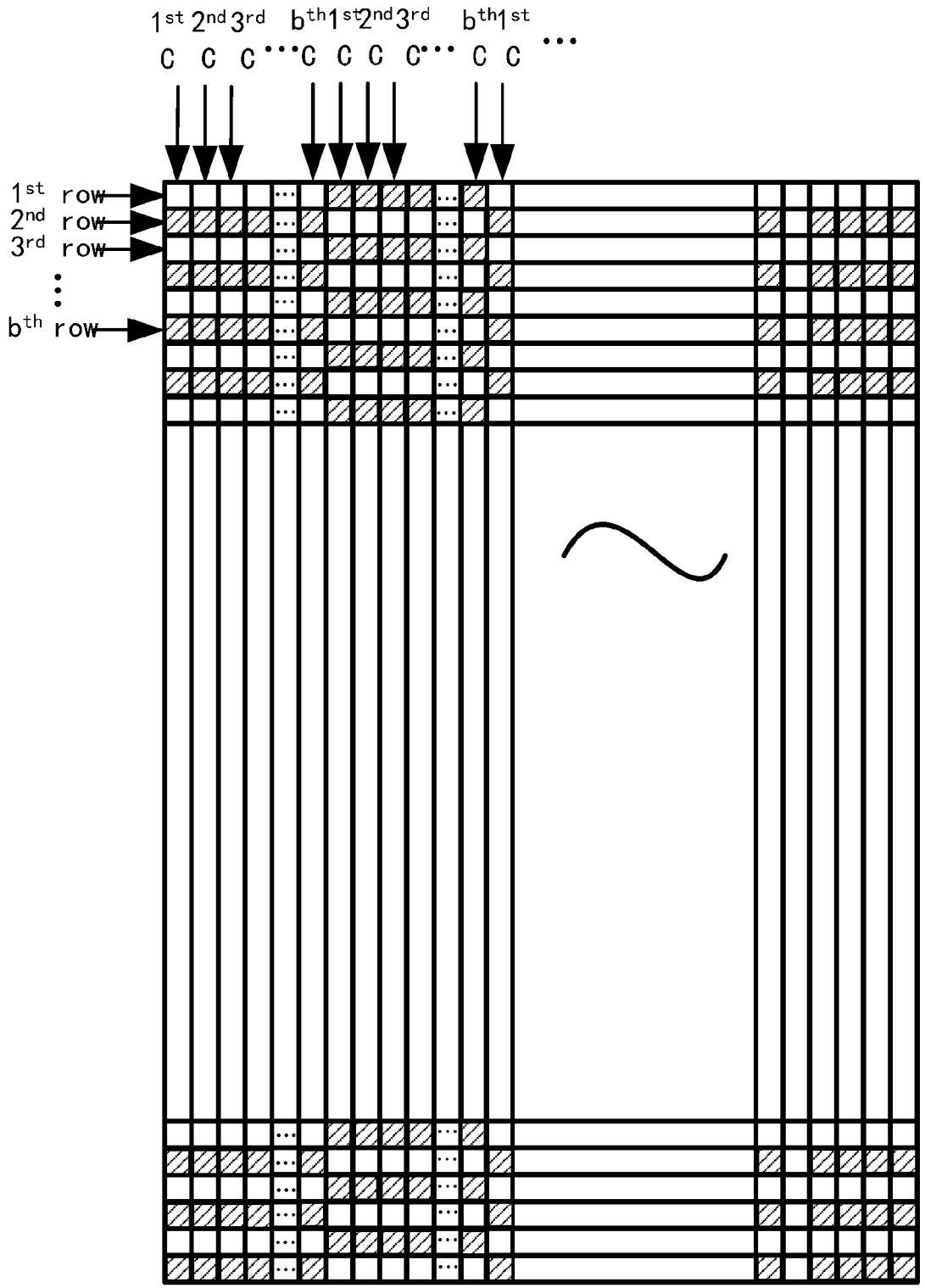
FIG. 3C is a schematic diagram illustrating a second type of display updating according to an exemplary embodiment.

A plurality of non-successive pixels may also be selected as the first portion of the display unit. For example, the first portion of the display units may include i first cells, and the second portion of the display units may include j second cells. The first cells may alternate with the second cells. Each of the first cells may include p pixels, and each of the second cells may include q pixels. Referring to FIGS. 3B and 3C, where the p pixels of the first cell and the q pixels of the second cell constitute a matrix of b*b pixels, wherein the dashed areas represent the first portion and the blank areas represent the second portion. The number p and q, however, may also be different and their values are not limited to the embodiment.

Figure 3D:
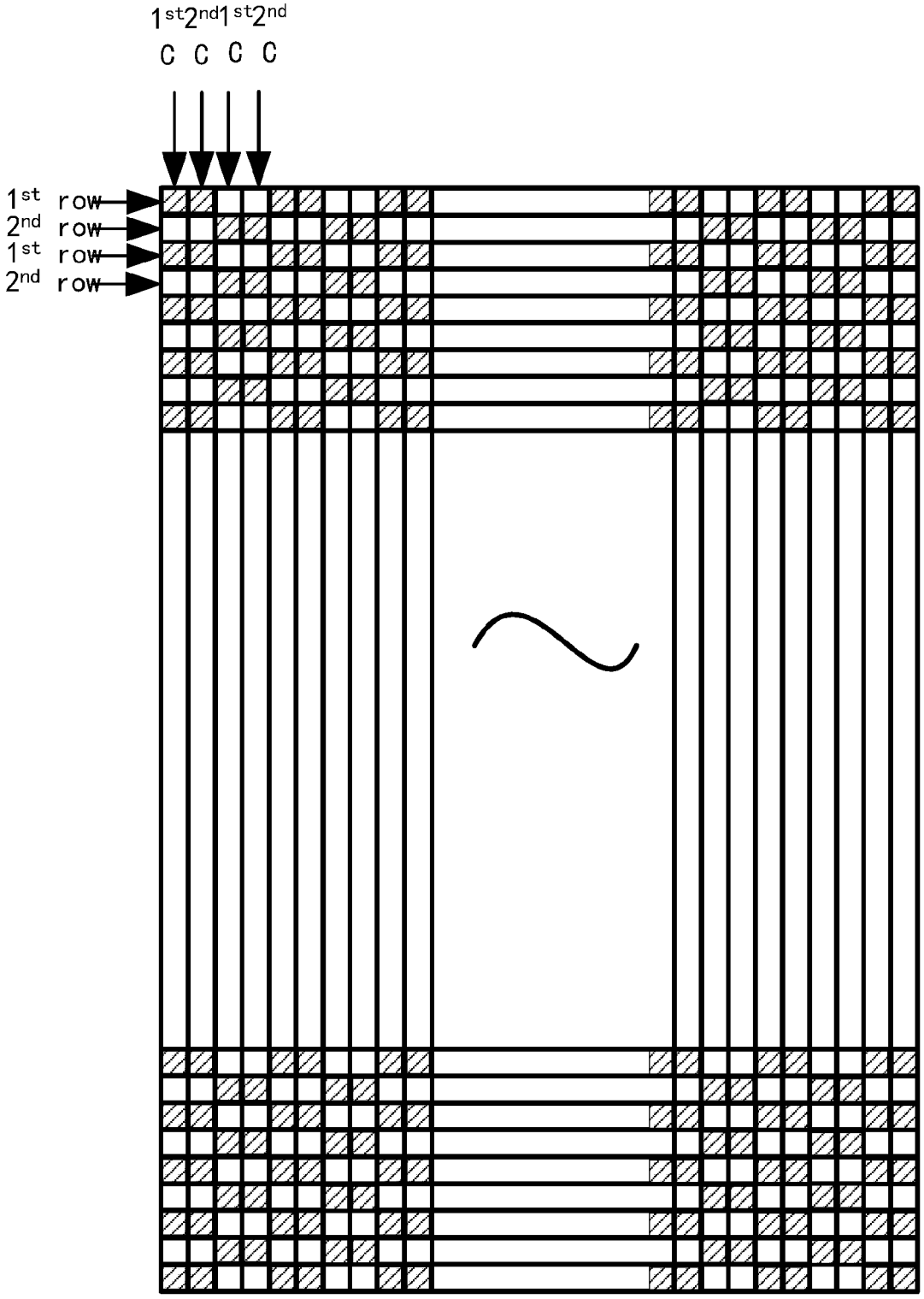
FIG. 3D is a schematic diagram illustrating a third type of display updating according to an exemplary embodiment.
Figure 3E:
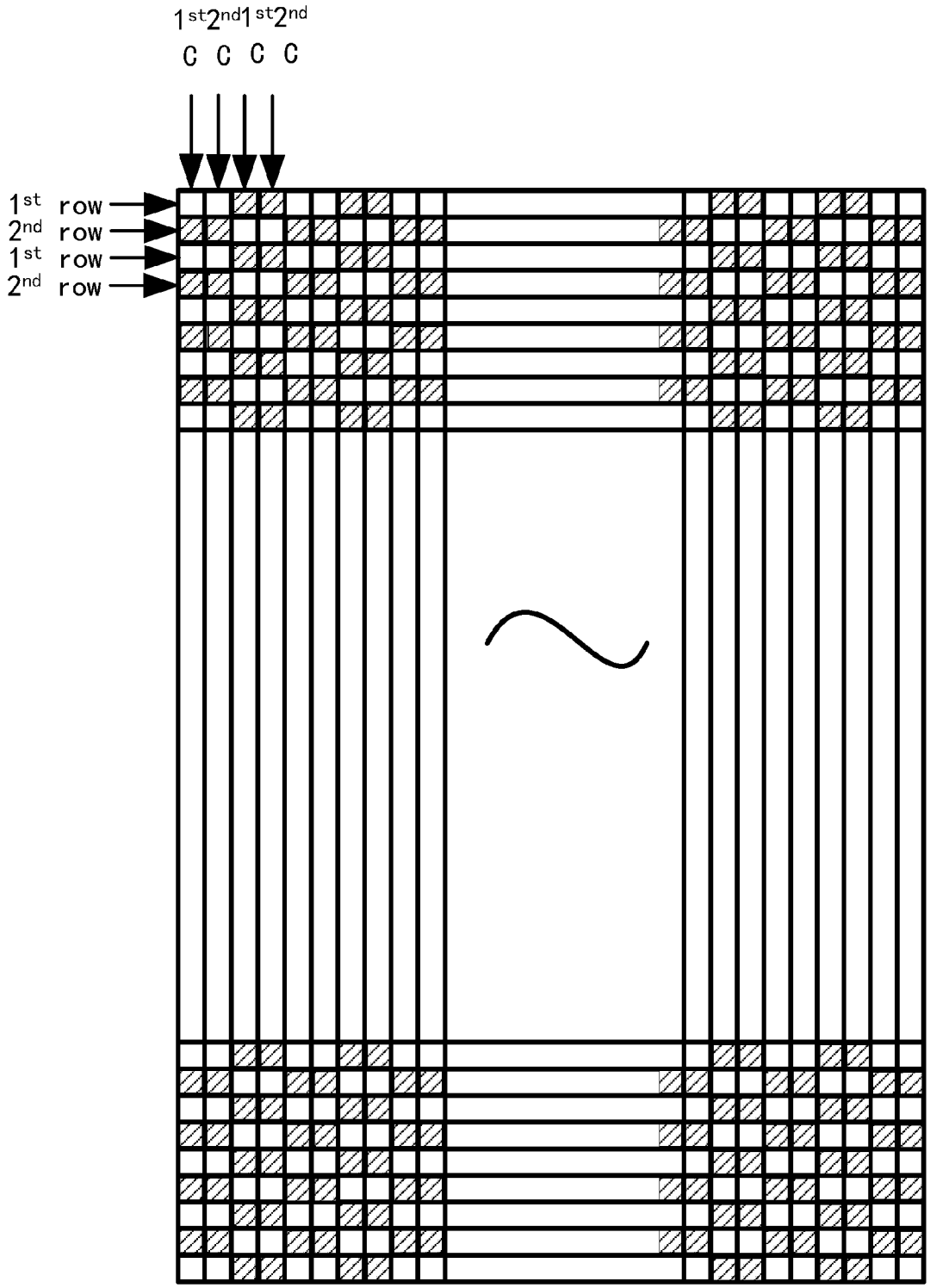
FIG. 3E is a schematic diagram illustrating a fourth type of display updating according to an exemplary embodiment.

When p and q are both equal to 2, FIGS. 3D and 3E may be referred to. When p and q are both equal to 1, FIGS. 3F and 3G may be referred to. The dashed areas represent the first portion of display unit and the blank areas represent the second portion of display unit.

In this embodiment, for each two adjacent rows of display units, all of the first cells of a first row of display units and all of the first cells of a second row of display units interlace with each other in columns. Moreover, all of the second cells of the first row of display units of the two adjacent rows of display units and all of the second cells of the second row of display units of the two adjacent rows of display units interlace with each other in columns. In above FIG. 3B-3G the dashed areas of the two adjacent rows of display units interlace with each other in column direction.

It should be supplemented that when the row of display units is a row of pixels, the p pixels of the first cell are successive in the row; when the display unit is a combination of two or more rows of pixels, the p pixels of the first cell and the q pixels of the corresponding second cell form a matrix of b*b pixels, where b pixels of each row of the first cell or the second cell are successive and pixels of each column (simply referred to "C" in these figures) of the first cell or the second cell are non-successive. For example, the p pixels of the first cell include 1 to b pixels of the first row, 1 to b pixels of the third row, 1 to b pixels of the fifth row; the q pixels of the second cell include 1 to be pixels of the second row, the 1 to b pixels of the fourth row, and so on, with reference to FIGS. 3B and 3C.

Figure 3F:
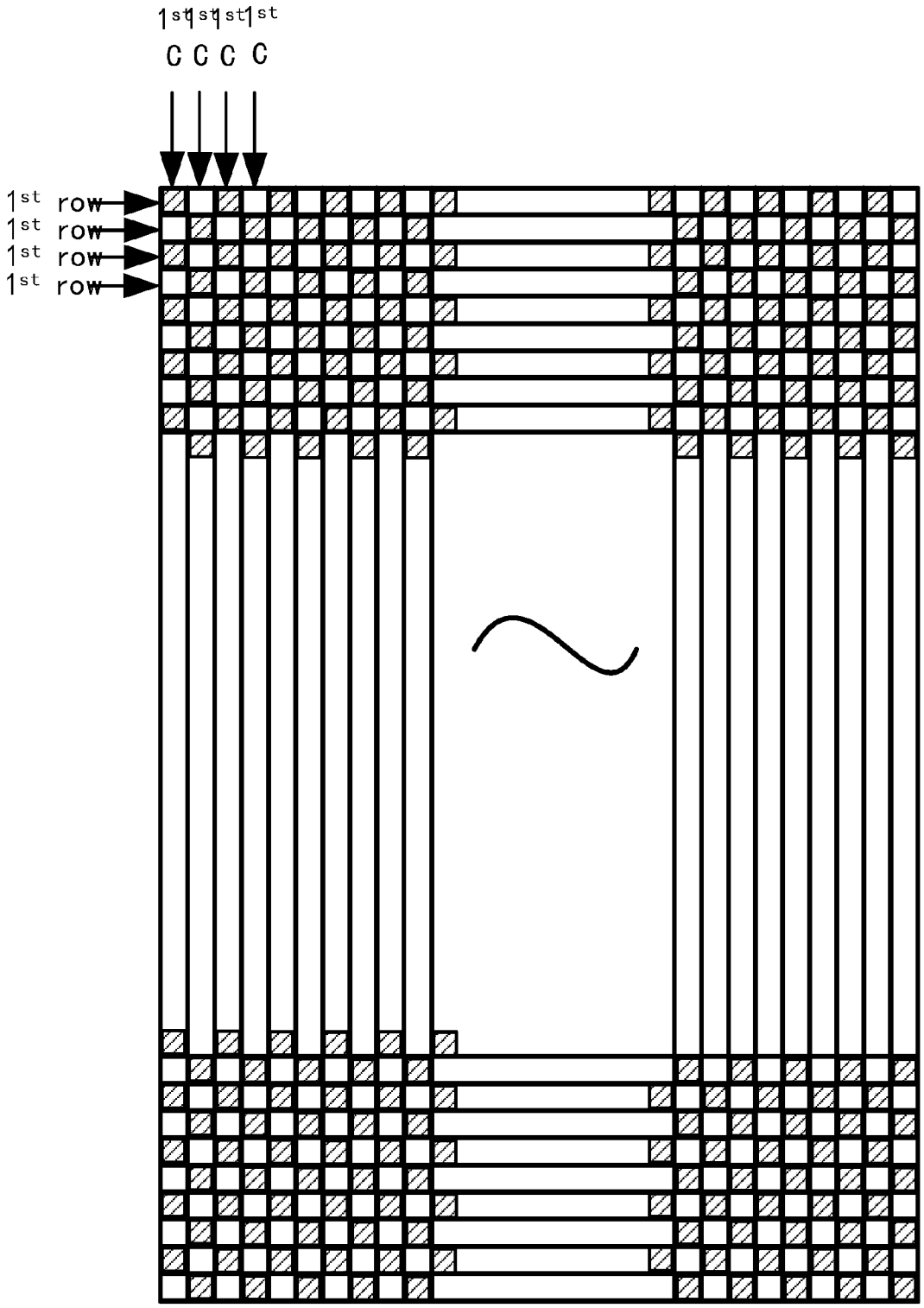
FIG. 3F is a schematic diagram illustrating a fifth type of display updating according to an exemplary embodiment.
Figure 3G:
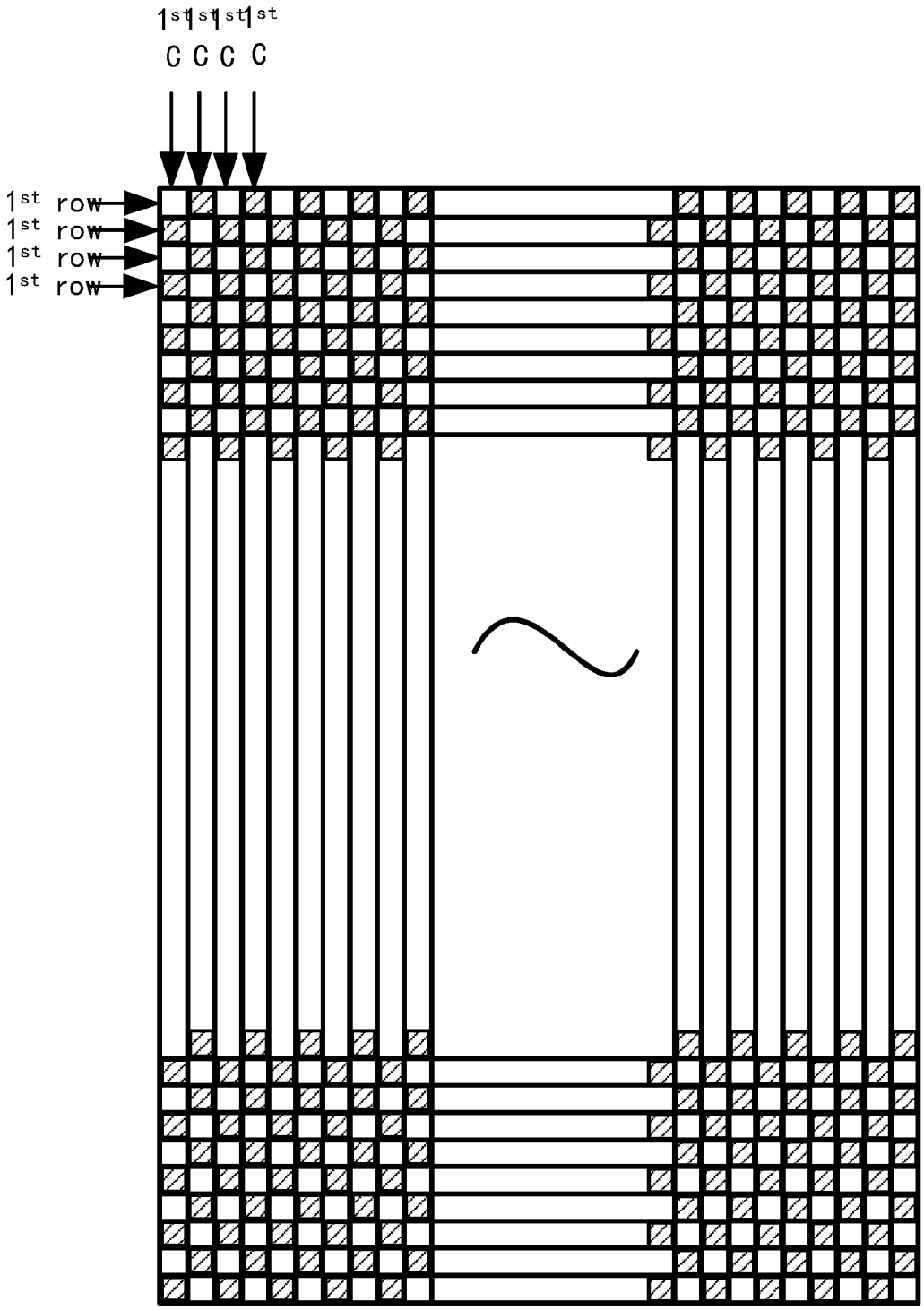
FIG. 3G is a schematic diagram illustrating a sixth type of display updating according to an exemplary embodiment.

When it is detected that the displayed content does not change, the terminal device may control the display to update only the display data corresponding to the first cells at an odd-numbered update, and to update only the display data corresponding to the second cells at an even-numbered update. In other words, the dashed areas in FIGS. 3B, 3D and 3F are updated at the odd-numbered updates, and the dashes areas in FIGS. 3C, 3E and 3G are updated at the even numbered-updates.

In a second alternative implementation, when the display unit of the display is a combination of n columns of pixels, each third portion of the display units may include k first cells, and each fourth portion of the display units may include l third cells. The third cells may alternate with the fourth cells. The number k and l may be positive integers. Each third cell may include r pixels, and each fourth cell may include s pixels, wherein r and s may be positive integers.

In the implementation, for two adjacent column display units, all the third cells of a first column display unit of the two adjacent column display units and all the third cells of a second column display unit of the two adjacent column display units interlace with each other in their row direction, and all the fourth cells of the first column display unit of the two adjacent column display units and all the fourth cells of the second column display unit of the two adjacent column display units interlace with each other in their row direction.

The second implementation is similar to the first implementation, so those detailed descriptions for the first implementation may be referred for the second implementation.

Figure 3H:
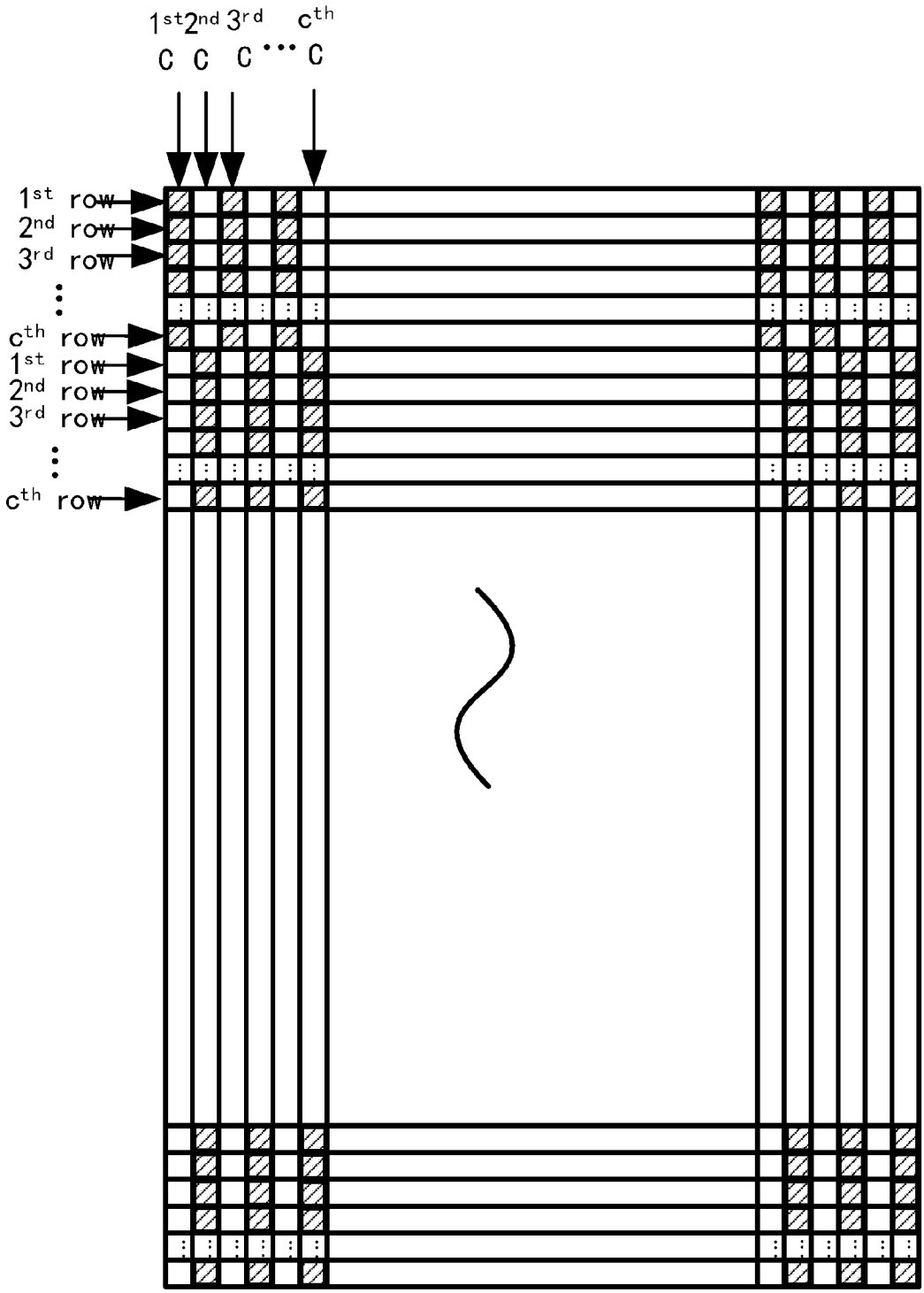
FIG. 3H is a schematic diagram illustrating a seventh type of display updating according to an exemplary embodiment.
Figure 3I:
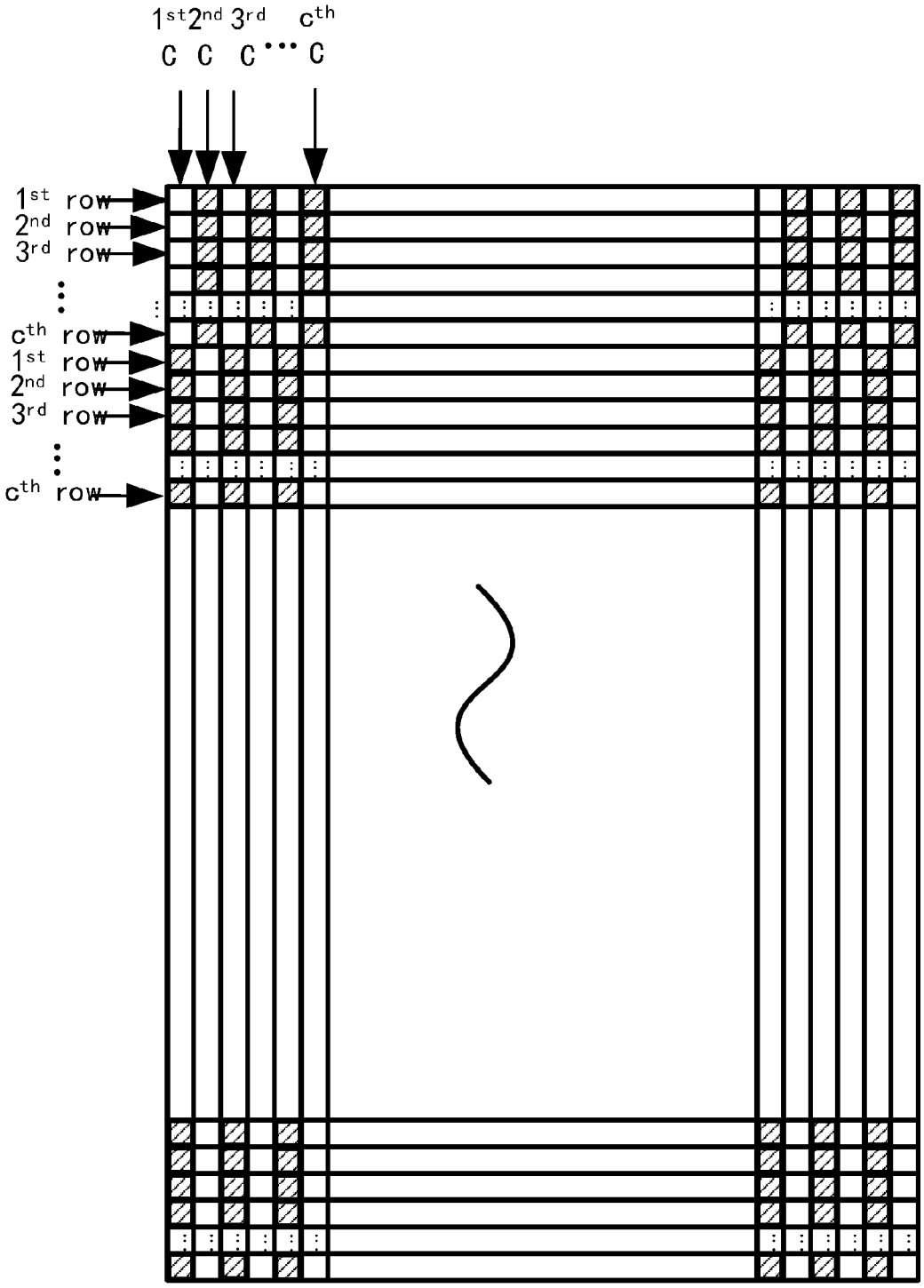
FIG. 3I is a schematic diagram illustrating an eighth type of display updating according to an exemplary embodiment.

In addition, referring to FIGS. 3H and 3I, the r pixels of the third cells and the s pixels of the fourth cells forma c*c matrix of pixels, and the dashed areas represent the first portion of display units and the blank areas represent the second portion of display units. r and s may be different, which are not limited to the embodiment.

Figure 3J:
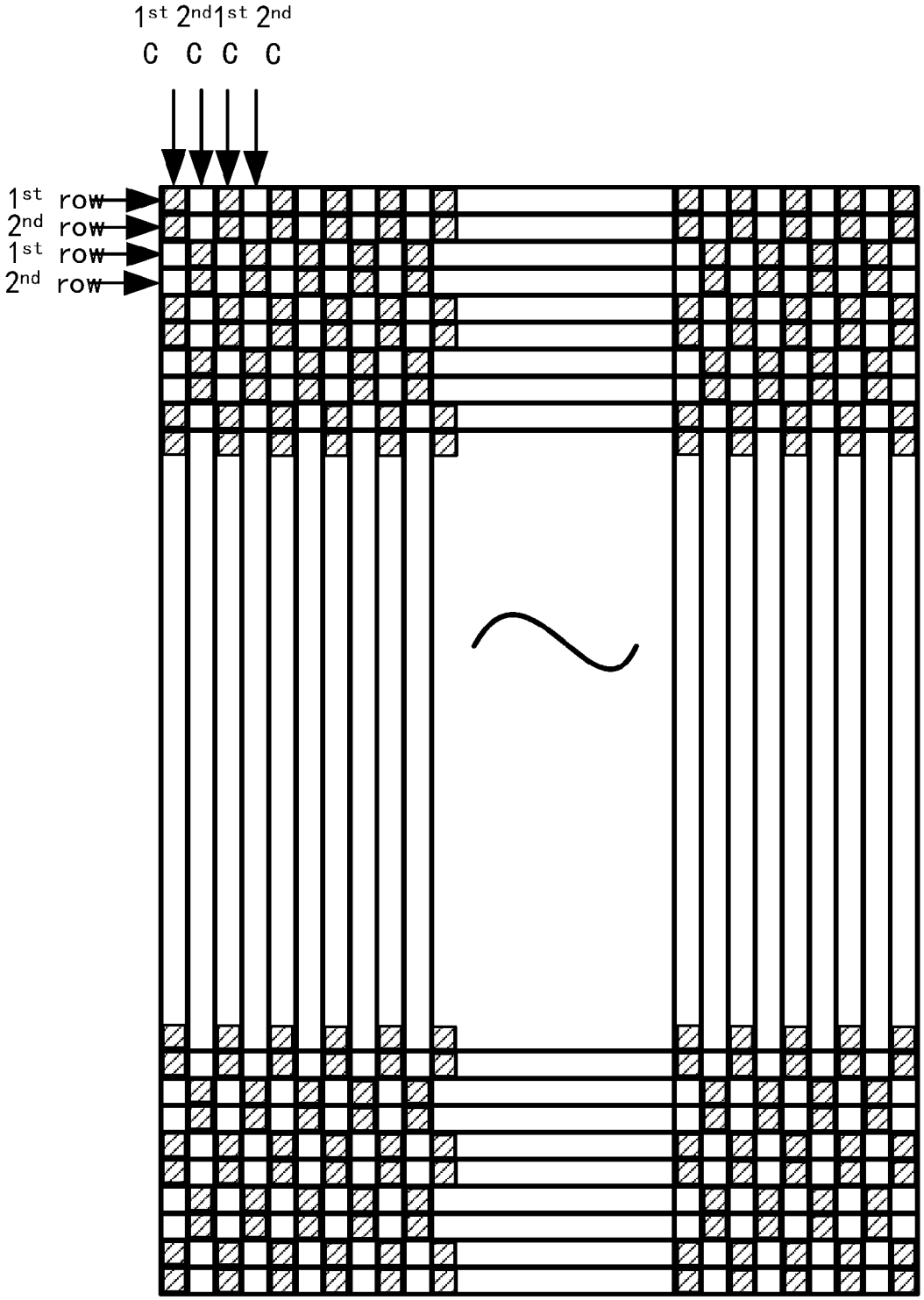
FIG. 3J is a schematic diagram illustrating a ninth type of display updating according to an exemplary embodiment.
Figure 3K:
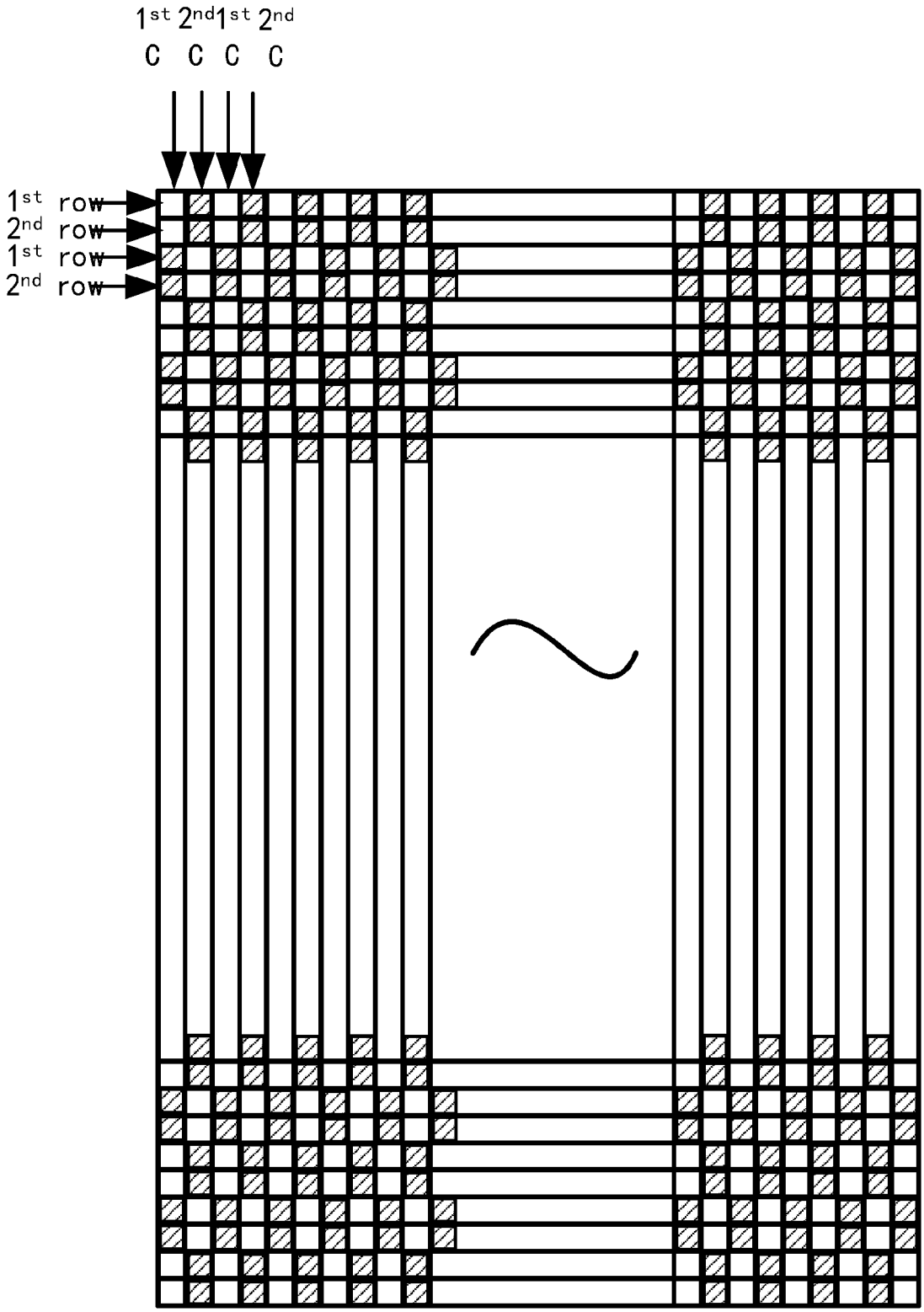
FIG. 3K is a schematic diagram illustrating a tenth type of display updating according to an exemplary embodiment.

When r and s are both equal to 2, FIGS. 3J and 3K may be referred, and when r and s are both equal to 1, FIGS. 3F and 3G may be referred, which is similar to the case in the first implementation where p and q are both equal to 1. The dashed areas represent the first portion of display units and the blank areas represent the second portion of display units.

In case that it is detected that the displayed content does not change, the terminal device may control the display to update only display data corresponding to the third cells at an odd-numbered update, and to update only display data corresponding to the fourth cells at an even-numbered update. That is, the dashed areas in FIG. 3H, FIG. 3J and FIG. 3F are updated at the odd-numbered updates, and the dashed areas in FIG. 3I, FIG. 3K and FIG. 3J are updated at an even-numbered updates.

It is understandable that, with the above method, only a portion of display data rather than the entire display data is required to be updated each time the display refreshes if the displayed content does not change. For example, when a first display portion and a second display portion of row display units are alternately updated or a third display portion and a fourth display portion of column display units are alternately updated, the amount of display data to be updated is half of the original amount for each refresh, thereby significantly reducing the power consumption of the display.

There are three alternative implementations as follows regarding the terminal device controlling the display to update the displayed content.

Figure 3L:
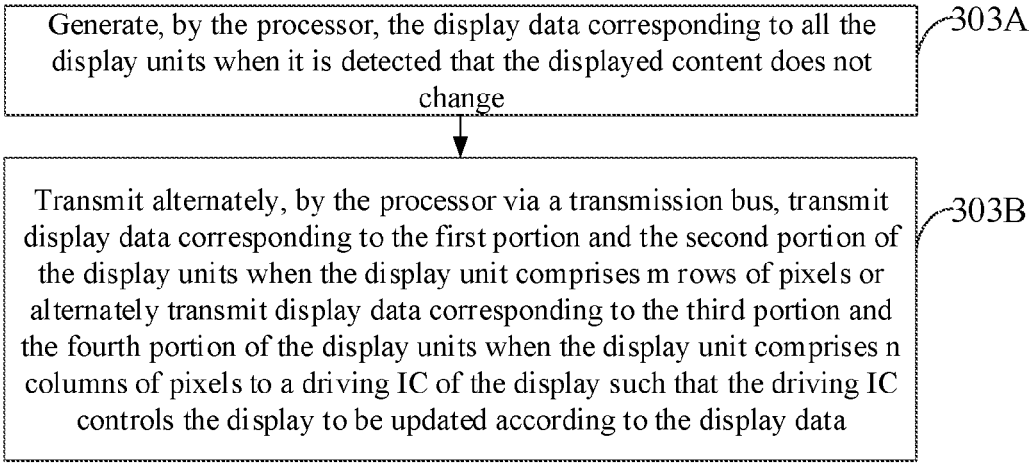
FIG. 3L is a flow chart of procedure of a display method related to a first type of display according to an exemplary embodiment.

In the first alternative implementation, as shown in FIG. 3L, the above step 303 may include the following steps.

In step 303A, when it is detected that the displayed content does not change, the display data corresponding to all of the display units in the displayed content is generated by the processor.

When detecting that the displayed content does not change, the processor of the terminal device generates the display data corresponding to all of the displayed content according to the resolution of the display. The processor may be a CPU or a GPU. For example, if the resolution of the display is 1080*1920, the data amount of the display data corresponding to the displayed content generated by the processor is 1080*1920=2073600 pixels.

In step 303B, when the display unit is a combination of m rows of pixels, the processor alternately transmits the display data corresponding to a first portion and a second portion of the display unit to the driving IC of the display via a transmission bus. Alternatively, when the display unit is a combination of n columns of pixels, the processor alternately transmits the display data corresponding to a third portion and a fourth portion of the display unit to the driving IC of the display via a transmission bus. The driving IC controls the update of the display to update according to the received display data.

In order to decrease the data amount of the display data to be updated by the display when the displayed content does not change, when detecting that the displayed content does not change, the processor alternately transmits the display data corresponding to the first portion and the second portion of the display unit to the driving IC of the display via the transmission bus if the display unit is a combination of m rows of pixels, or alternately transmits the display data corresponding to the third portion and the fourth portion of the display unit if the display unit is a combination of n columns of pixels.

After receiving the display data via the transmission bus, the driving IC controls corresponding pixels in the display to update the displayed content according to the display data. Since the transmission bus alternately transmits the display data corresponding to the first portion of the display unit and the second portion of the display unit, only the display data corresponding to the first portion of display units or the second portion of display units is updated in each refresh of the displayed content by the display. Alternatively, the transmission bus alternately transmits the display data corresponding to the third portion of the display unit and the fourth portion of the display unit, only the display data corresponding to the third portion of the display unit or the fourth portion of the display unit is updated in each refresh of the displayed content by the display. Compared with traditional updating methods, the amount of data to be updated required by the method of alternatively transmitting the display data corresponding to a portion of the display units is significantly reduced. Moreover, the user's visual perception will not be significantly affected. Additionally, since the amount of data transmitted via the transmission bus is significantly reduced, the electromagnetic interference caused by the data transmission is reduced accordingly, thereby ensuring normal operation of other components in the terminal device.

It should be noted that, upon detection of any change in the displayed content, the processor may send the complete display data to the driving IC via the transmission bus. The driving IC may then control the display to update the display data corresponding to the displayed content.

In this embodiment, when there is no change in the displayed content, the processor alternately transmits the display data corresponding to the first portion and the second portion of the display unit to the driving IC of the display via the transmission bus when the display unit is a combination of m rows of pixels. Alternatively, the processor alternately transmits display data corresponding to the third portion and the fourth portion of the display unit to the driving IC of the display when the display unit is a combination of n columns of pixels. The driving IC controls the display to refresh the displayed content according to the received display data. Thus, the power consumption of the transmission bus is reduced and the electromagnetic interference caused by the transmission of the display data through the transmission bus can also be reduced.

Figure 3M:
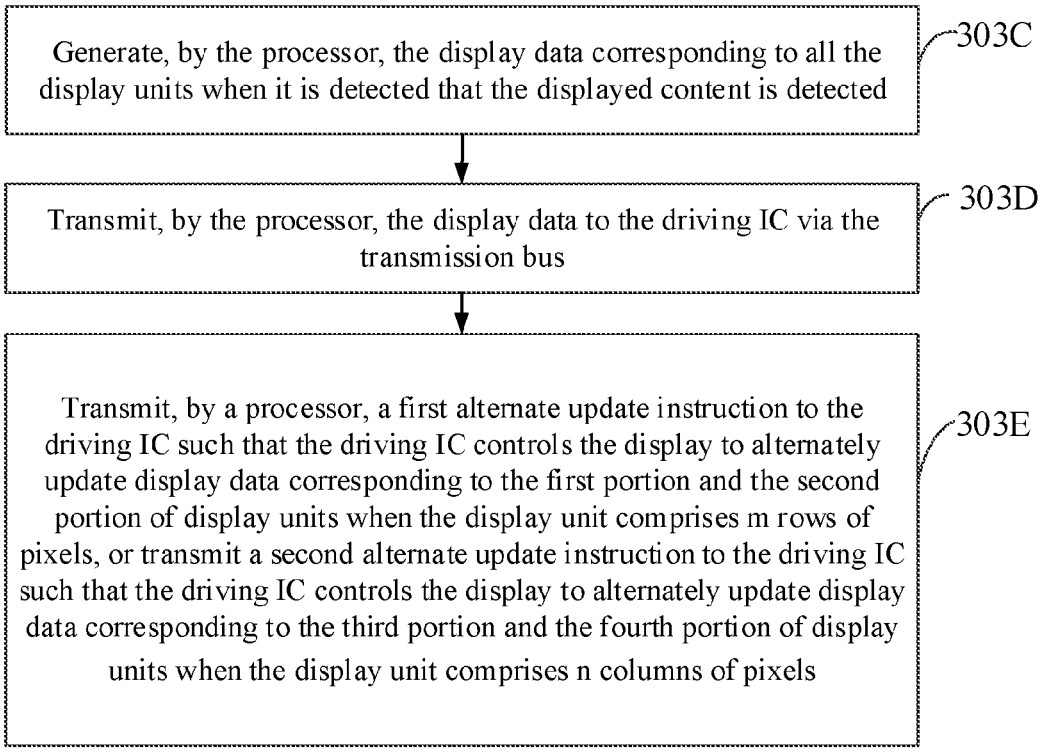
FIG. 3M is a flow chart of procedure of a display method related to a second type of display according to an exemplary embodiment.

In the second alternative implementation, as shown in FIG. 3M, the above step 303 may include the following steps.

In step 303C, if it is detected that the displayed content does not change, the display data corresponding to the displayed content is generated by the processor.

The implementation manner of this step is similar to that of the above step 303A and thus its description is not provided here.

In step 303D, the display data is transmitted by the processor to the driving IC of the display via the transmission bus.

Different from the above step 303B, in step 303D the complete display data is transmitted by the processor to the driving IC via the transmission bus.

In step 303E, when the display unit is a combination of m rows of pixels, a first alternate update instruction is sent by the processor to the driving IC. The driving IC controls the display to alternately update the display data corresponding to the first portion and the second portion of the display unit according to the first alternate update instruction. Alternatively, when the display unit is a combination of n columns of pixels, a second alternate update instruction is sent by the processor to the driving IC such that the driving IC controls the display to alternately update the display data corresponding to the third portion and the fourth portion of the display unit of the display data according to the second alternate update instruction.

While transmitting the complete display data to the transmission bus, the processor sends the alternate update instruction to the driving IC to instruct the driving IC to control the display to alternately update display data corresponding to the first portion and the second portion of the display unit of the display data in when the display unit is a combination of m rows of pixels, or instruct the driving IC to control the display to alternately update the display data corresponding to the third portion and the fourth portion of the display unit when the display unit is a combination of n columns of pixels, thus the display data of the display is updated alternatively, thereby reducing the power consumption when the displayed content of the display does not change.

It should be noted that when there is any change in the displayed content, the processor transmits the complete display data to the driving IC via the transmission bus and does not send the alternate update instruction. Accordingly, the driving IC controls the display to update the display data for all of the display units.

In the embodiment, when there is no change in the displayed content, while transmitting the display data corresponding to all of the display units to the driving IC, the processor also transmits an alternate update instruction to the driving IC to instruct the driving IC to control the display to alternately update display data corresponding to the first portion of the display unit and the second portion of display unit, or instruct the driving IC to control the display to alternately update display data corresponding to the third portion of the display unit and the fourth portion of the display unit of the display data, thereby reducing the amount of the display data in the display to be updated and reducing the power consumption of the display if the displayed content does not change.

Figure 3N:
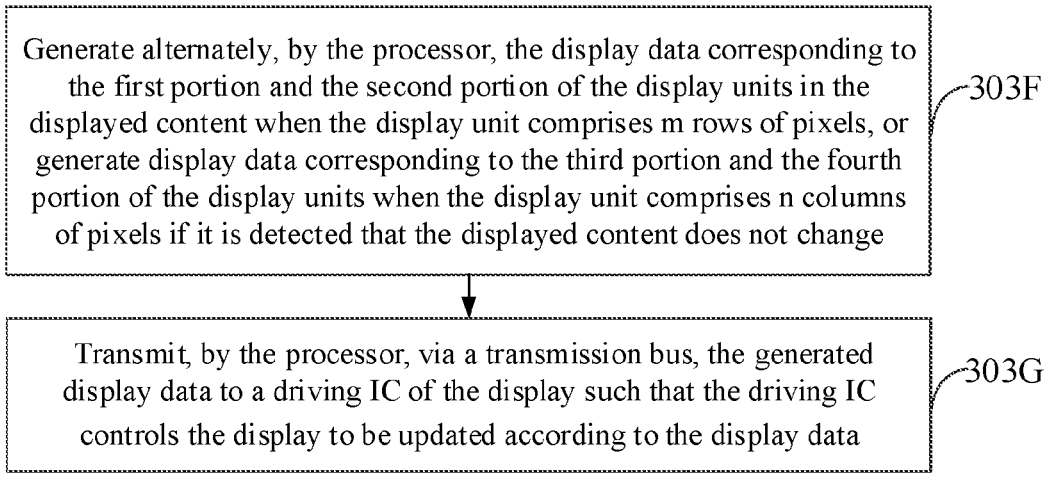
FIG. 3N is a flow chart of procedure of a display method related to a third type of display according to an exemplary embodiment.

In the third alternative implementation, as shown in FIG. 3N, the above step 303 may include the following steps.

In step 303F, if it is detected that the displayed content does not change, the display data corresponding to the displayed content of the first portion and the second portion of the display unit is alternately generated by the processor when the display unit is a combination of m rows of pixels; or the display data corresponding to the displayed content of the third portion and the fourth portion of the display unit is alternately generated by the processor when the display unit is a combination of n columns of pixels.

Different from the above step 303A and step 303C, if it is detected that the displayed content does not change, the processor alternately generates display data corresponding to the displayed content of the first portion of the display unit or the second portion of display unit or alternately generates display data corresponding to the displayed content of the third portion of the display unit and the fourth portion of the display unit during display data generation stage. Instead of generating complete display data, only a portion of the display data is generated. Thus, the processing resources consumed by the processor when generating the display data is significantly reduced, thereby reducing the power consumption of the processor is reduced accordingly.

In step 303G, the generated display data is transmitted by the processor to the driving IC of the display via the transmission bus. The driving IC controls the display to refresh the displayed content according to the received display data.

The processor alternately generates display data corresponding to the displayed content of the first portion of the display unit and the second portion of the display unit, or alternately generates display data corresponding to the third portion of the display unit and the fourth portion of the display unit, and transmits the generated display data to the driving IC via the transmission bus. The driving IC then controls the display to refresh the displayed content accordingly based on the display data. Thus, when the displayed content does not change, not only the amount of data to be updated is reduced, but also the amount of data to be transmitted through the transmission bus is reduced, such that the electromagnetic interference caused by the transmission of the display data through the transmission bus is reduced.

In this embodiment, when the displayed content does not change, the processor alternately generates the display data corresponding to the displayed content of the first portion and the second portion of the display unit or alternately generates the display data corresponding to the displayed content of the third portion of the display units and the fourth portion of the display unit, and transmits the generated display data to the driving IC of the display via the transmission bus. The driving IC then controls the display to refresh the displayed content alternately based on the display data. Thus, not only the amount of the display data to be generated by the processor and the power consumption of the display can be reduced, but also the power consumption of the transmission bus and the electromagnetic interference caused by the transmission of the display data through the transmission bus can be reduced.

After the driving IC obtains the display data through the above three methods, it may control the display to refresh the displayed content. In implementations, step 303 may further includes: when the display unit is a combination of m rows of pixels, during an odd-numbered update, switch of each pixel of each of the first cells is controlled by the driving IC to be in a first state and switch of each pixel of each of the second cells is controlled by the driving IC to be in a second state; and during an even-numbered update, the switch of each pixel of each of the first cells is controlled by the driving IC to be in the second state and the switch of each pixel of each of the second cells is controlled by the driving IC to be in the first state. Alternatively, when the display unit of the display is a combination of n columns of pixels, during an odd-numbered update, switch of each pixel of each of the third cells is controlled by the driving IC to be in the first state and switch of each pixel of each of the fourth cells is controlled by the driving IC to be in the second state, and during an even-numbered update, the switch of each pixel of each of the third cells is controlled by the driving IC to be in the second state and the switch of each pixel of each of the fourth cells is controlled by the driving IC to be in the first state.

In circuit implementation, each pixel may be electrically connected to the driving IC through an enable line, and each pixel may be electrically connected to a data line through a switch. The driving IC may control the state of the switches corresponding to the pixels through respective enable lines. The first state may be an on state and the second state may be an off state. Alternatively, the first state may be the off state and the second state may be the on state.

For example, when the driving IC controls a switch for a pixel through an enable line to be in the on state, the display data is transmitted through the data line to update the display data of the pixel; when the driving IC controls the switch of the pixel through the enable line to be in the off state, the display data of the pixel remains unchanged.

Figure 3O:
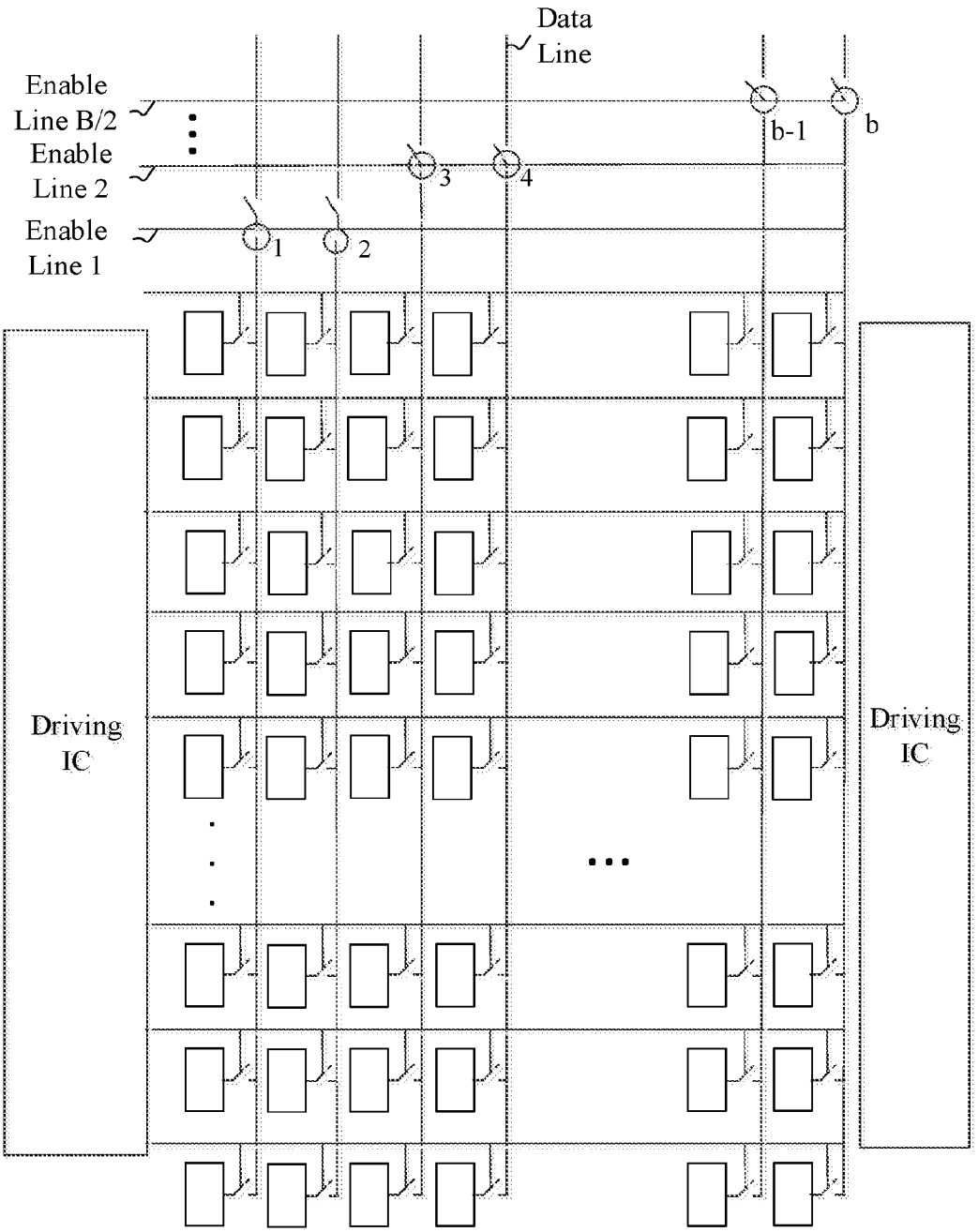
FIG. 3O is a circuit diagram showing procedure of a display method related to certain type of display according to an exemplary embodiment.

In this embodiment, one data line be provided for each pixel or for a plurality of pixels, which is not limited to the embodiment. Referring to FIG. 3O, in this example, a data line is provided for a row of pixels. Assuming that the first cells and the second cells each includes 2 successive pixels, when a first row of pixels are scanned, that is, when the display data corresponding to the first row of display unit is updated, switches 1 and 2 are controlled to be in the on state by enable line 1, switches 3 and 4 are controlled to be in the off state by enable line 2, . . . , and so on, switches b−1 and b are controlled to be in the on state by enable line b/2; when a second row of pixels are scanned, switches 1 and 2 are controlled to be in the off state by enable line 1, switches 3 and 4 are controlled to be in the on state by enable line 2, . . . , and so on, and switches b−1 and b are controlled to be in the off state by enable line b/2.

From the above, according to the display methods provided by the embodiments, by detecting whether the displayed content changes and controlling the display to alternately update display data corresponding to a first portion and a second portion of display units within the displayed content or alternately update display data corresponding to a third portion and a fourth portion of display units within the displayed content if it is detected that the displayed content does not change, the number of the pixels to be updated by the display in each update can be reduced while keeping the refresh frequency of the display unchanged, thereby solving the problem of screen flicker due to the reduction of refreshing frequency and reducing power consumption of the display.

Additionally, by applying the above embodiments of controlling a display to update contents, power consumption of a transmission bus can be reduced, and electromagnetic interference caused by transmission of display data through the transmission bus can be reduced.

Figure 4:
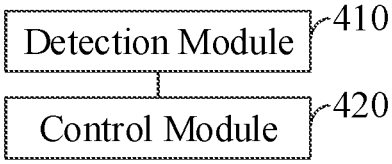
FIG. 4 is a block diagram of a display device according to an exemplary embodiment.

FIG. 4 is a block diagram of a display device according to an exemplary embodiment. As shown in FIG. 4, the display device may include: a detection module 410 and a control module 420.

The detection module 410 may be configured to detect whether there is any change in a displayed content for a display.

The control module 420 may be configured to control the display to alternately update display data corresponding to a first portion and a second portion of each row display unit when the display unit is a combination of a set of m rows of pixels if it is detected by the detection module 410 that the displayed content for the display does not change, where m may be a positive integer. Alternatively, the control module 420 may be configured to control the display to alternately update display data corresponding to a third portion and a fourth portion of each column display unit when the display unit is a combination of n columns of pixels if it is detected by the detection module 410 that the displayed content for the display does not change, where n may be a positive integer.

From the above, the display device provided by the disclosure, by detecting whether there is any change in the displayed content for the display and controlling the display to alternately update display data corresponding to the displayed content of the first portion and second portion of the display unit or alternately update display data corresponding to the displayed content of the third portion and fourth portion of display units within the displayed content if it is detected that the displayed content does not change, the number of the pixels to be updated by the display in each update can be reduced while keeping the refresh frequency of the display unchanged. Thus, the issue of screen flicker due to the screen flicker can be avoided and power consumption of the display is reduced while keeping the refresh frequency of the display unchanged.

Figure 5:
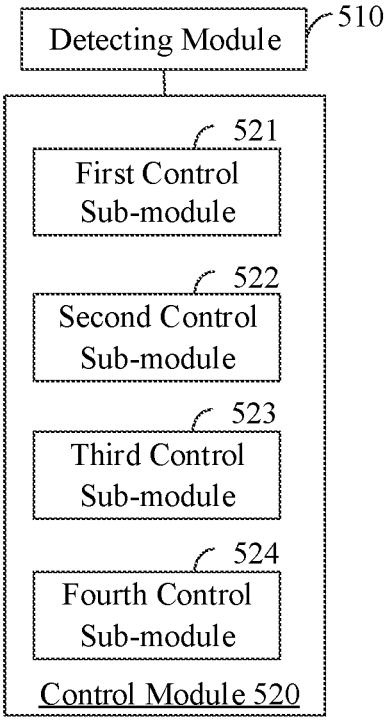
FIG. 5 is a block diagram of a display device according to another exemplary embodiment.

FIG. 5 is a block diagram of a display device according to an exemplary embodiment. As shown in FIG. 5, the display device may include a detection module 510 and a control module 520.

The detection module 510 may be configured to detect whether there is any change in a displayed content for a display.

The control module 520 may be configured to control the display to alternately update display data corresponding to a first portion and a second portion of all row display units when the display unit of the display is a combination of m rows of pixels and alternately update display data corresponding to a third portion and a fourth portion of all column display units of the display when the display unit of the display is a combination of n columns of pixels if it is detected by the detection module 510 that the displayed content does not change.

Alternatively, when the display unit of the display is a combination of m rows of pixels, each first portion of the display unit may include i first cells, and each second portion of the display unit may include j second cells. The first cells may alternate with the second cells. i and j may be positive integers.

Each first cell may include p pixels, and each second cell may include q pixels, wherein p and q are positive integers.

Additionally, for each two adjacent row display units, each of the first cells of the first row of display units of the two adjacent rows of display units and each of the first cells of a second row of display units of the two adjacent rows of display units interlace with each other in columns; and each of the second cells of the first row of display units and all the second cells of the second row of display units interlace with each other in column direction.

Additionally, each pixel is electrically connected to a driving IC through an enable line, and each pixel is electrically connected to a data line through a switch, and the control module 520 may include: a first control sub-module 521 and a second control sub-module 522.

The first control sub-module 521 may be configured to control, by the driving IC, switches of all of the pixels of each of the first cells to be in a first state and switches of all of the pixels of each of the second cells to be in a second state at an odd numbered update.

The second control sub-module 522 may be configured to control, by the driving IC, the switches for all the pixels within each of the first cells to be in the second state and the switches for all the pixels within each of the second cells to be in the first state during an even numbered update.

Additionally, when the display unit of the display is a combination of n columns of pixels, each third portion of the display unit may include k third cells, and each fourth portion of the display unit may include l fourth cells, and the third cells alternate with the fourth cells, wherein k and l are positive integers. Each third cell may include r pixels, and each fourth cell may include s pixels, wherein r and s are positive integers.

Alternatively, for two adjacent column display units, each of the third cells of a first column of the display unit and each of the third cells of a second column of display units interlace with each other in row direction; and each of the fourth cells of the first column of the display unit and each of the fourth cells of the second column of the display unit interlace with each other in row direction.

Alternatively, each pixel is electrically connected to a driving integrated circuit IC through an enable line and each pixel is electrically connected to a data line through a switch. The control module 520 may further include a third control sub-module 523 and a fourth control sub-module 524.

The third control module 523 is configured to control, by the driving IC, switches of all of the pixels of each of the third cells to be in a first state and control switches of all of the pixels of each of the fourth cells to be in a second state during an odd numbered update.

The fourth control module 524 is configured to control, by the driving IC, switches of all of the pixels of each of the third cells to be in the second state and switches of all of the pixels of each of the fourth cells to be in the first state during an even numbered update.

From the above, for the display device provided by the embodiment, by detecting whether there is any change in the display content for the display and controlling the display to alternately update display data corresponding to the displayed content of the first portion and the second portion of the display unit or alternately update display data corresponding to the displayed content of the third portion and the fourth portion of the display unit if it is detected that the displayed content does not change, the number of the pixels to be updated by the display in each update can be reduced while keeping the refresh frequency of the display unchanged. Thus, the issue of screen flicker due to the screen flicker can be avoided and power consumption of the display can be reduced while keeping the refresh frequency of the display unchanged.

With respect to the devices in the above embodiments, the specific manners for performing operations for individual modules therein have been described in detail in the embodiments regarding related methods, which will not be elaborated herein.

Figure 6:
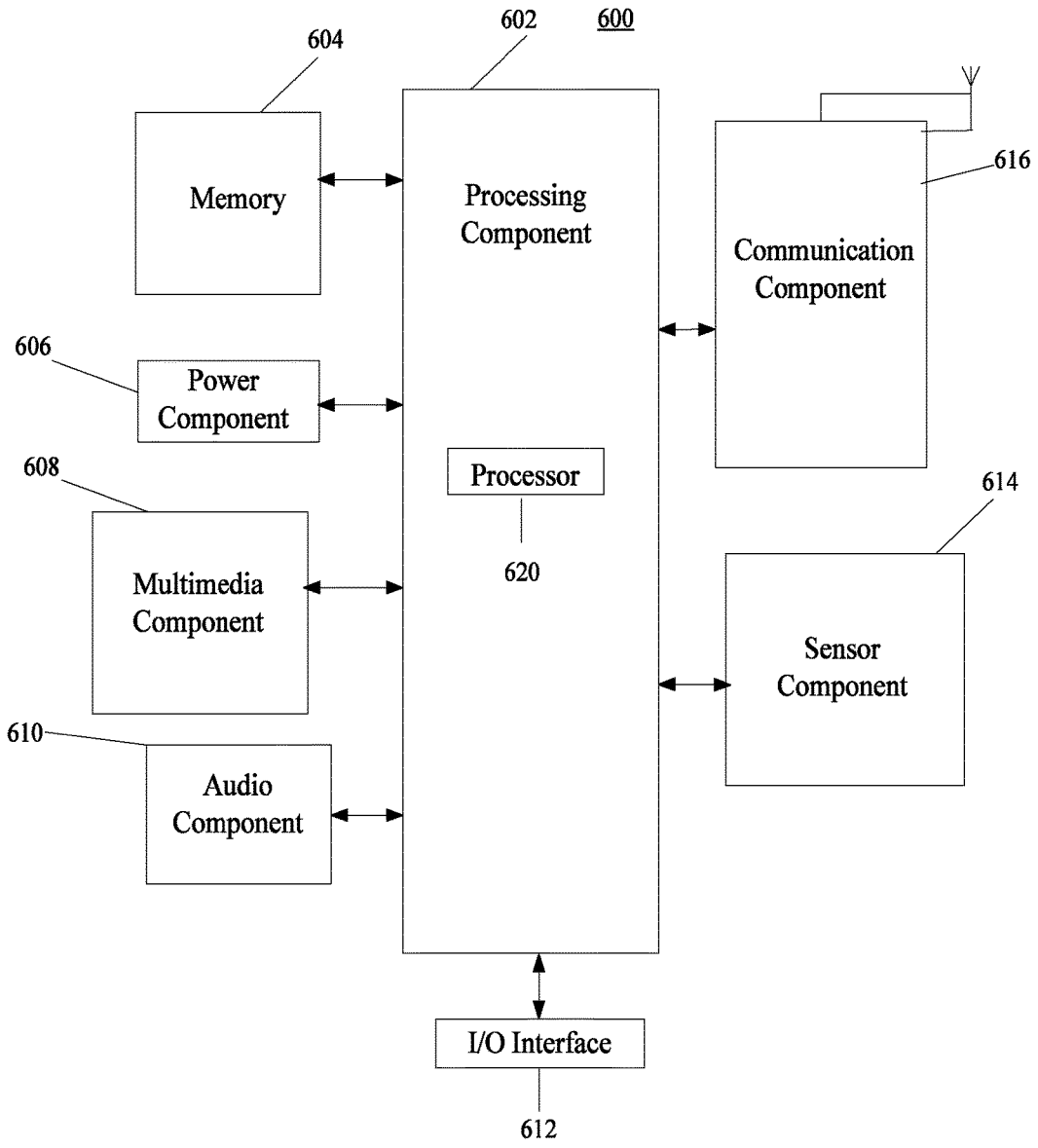
FIG. 6 is a block diagram of a device according to an exemplary embodiment.

FIG. 6 is a block diagram of a device illustrated according to an exemplary embodiment. For example, the device 600 may be a mobile phone, a computer, a digital broadcast terminal, a messaging device, a gaming console, a tablet, a medical device, exercise equipment, a personal digital assistant, and the like.

Referring to FIG. 6, the device 600 may include one or more of the following components: a processing component 602, a memory 604, a power component 606, a multimedia component 608, an audio component 610, an input/output (I/O) interface 612, a sensor component 614, and a communication component 616.

The processing component 602 typically controls overall operations of the device 600, such as the operations associated with display, telephone calls, data communications, camera operations, and recording operations. The processing component 602 may include one or more processors 618 to execute instructions to perform all or part of the steps in the above described methods. Moreover, the processing component 602 may include one or more modules which facilitate the interaction between the processing component 602 and other components. For instance, the processing component 602 may include a multimedia module to facilitate the interaction between the multimedia component 608 and the processing component 602.

The memory 604 is configured to store various types of data to support the operation of the device 600. Examples of such data include instructions for any applications or methods operated on the device 600, contact data, phonebook data, messages, pictures, video, etc. The memory 604 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 606 provides power to various components of the device 600. The power component 606 may include a power management system, one or more power sources, and any other components associated with the generation, management, and distribution of power in the device 600.

The multimedia component 608 includes a screen providing an output interface between the device 600 and the user. In some embodiments, the screen may include a liquid crystal display (LCD) and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 608 includes a front camera and/or a rear camera. The front camera and/or the rear camera may receive an external multimedia datum while the device 600 is in an operation mode, such as a photographing mode or a video mode. Each of the front camera and the rear camera may be a fixed optical lens system or have focus and optical zoom capability.

The audio component 610 is configured to output and/or input audio signals. For example, the audio component 610 includes a microphone ("MIC") configured to receive an external audio signal when the device 600 is in an operation mode, such as a call mode, a recording mode, and a voice recognition mode. The received audio signal may be further stored in the memory 604 or transmitted via the communication component 616. In some embodiments, the audio component 610 further includes a speaker to output audio signals.

The I/O interface 612 provides an interface between the processing component 602 and peripheral interface modules, such as a keyboard, a click wheel, buttons, and the like. The buttons may include, but are not limited to, a home button, a volume button, a starting button, and a locking button.

The sensor component 614 includes one or more sensors to provide state assessments of various aspects of the device 600. For instance, the sensor component 614 may detect an open/closed state of the device 600, relative positioning of components, e.g., the display and the keypad, of the device 600, a change in position of the device 600 or a component of the device 600, a presence or absence of user contact with the device 600, an orientation or an acceleration/deceleration of the device 600, and a change in temperature of the device 600. The sensor component 614 may include a proximity sensor configured to detect the presence of nearby objects without any physical contact. The sensor component 614 may also include a light sensor, such as a CMOS or CCD image sensor, for use in imaging applications. In some embodiments, the sensor component 614 may also include an accelerometer sensor, a gyroscope sensor, a magnetic sensor, a pressure sensor, or a temperature sensor.

The communication component 616 is configured to facilitate communication, wired or wirelessly, between the device 600 and other devices. The device 600 can access a wireless network based on a communication standard, such as WiFi, 2G or 3G, or a combination thereof. In one exemplary embodiment, the communication component 616 receives a broadcast signal or broadcast associated information from an external broadcast management system via a broadcast channel. In one exemplary embodiment, the communication component 616 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In exemplary embodiments, the device 600 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the above described methods.

In exemplary embodiments, there is also provided a non-transitory computer-readable storage medium including instructions, such as the memory 604 having stored therein instructions, when executed by the processor 618 in the device 600, for performing the above-described methods. For example, the non-transitory computer-readable storage medium may be a ROM, a RAM, a CD-ROM, a magnetic tape, a floppy disc, an optical data storage device, and the like.

Other embodiments of the disclosure will be apparent to those skilled in the art from consideration of the specification and practice of the disclosure disclosed here. This application is intended to cover any variations, uses, or adaptations of the disclosure following the general principles thereof and including such departures from the present disclosure as come within known or customary practice in the art. It is intended that the specification and examples be considered as exemplary only, with a true scope and spirit of the disclosure being indicated by the following claims.

It will be appreciated that the present disclosure is not limited to the exact construction that has been described above and illustrated in the accompanying drawings, and that various modifications and changes can be made without departing from the scope thereof. It is intended that the scope of the disclosure only be limited by the appended claims.

What is claimed is:

1. A display method for use in a device configured with a display, comprising:

detecting whether there is any change in a displayed content for the display;

in response to detecting that the displayed content for the display does not change, controlling the display to alternately update display data corresponding to a first portion and a second portion of display units in each row when the display unit comprises m rows of pixels; and in response to detecting that the displayed content for the display does not change, controlling the display to alternately update display data corresponding to a third portion and a fourth portion of display units in each column when the display unit comprises n columns of pixels, wherein m and n are positive integers, wherein each pixel is electrically connected to a driving integrated circuit (IC) through an enable line and electrically connected to a data line through a switch, and wherein said controlling the display to alternately update the display data corresponding to the first portion and the second portion of display units when the display unit comprises m rows of pixels comprises:

controlling, by the driving IC, switches of all of the pixels of each of the first cells to be in a first state and switches of all of the pixels of each of the second cells to be in a second state at an odd numbered update; and controlling, by the driving IC, the switches of all of the pixels of each of the first cells to be in the second state and the switches of all of the pixels of each of the second cells to be in the first state at an even numbered update.

2. The method of claim 1, wherein when the display unit comprises m rows of pixels, the first portion of the display units comprises i first cells, the second portion of the display units comprises j second cells, and the first cells alternate with the second cells, wherein i and j are positive integers; and wherein the first cell comprises p pixels, and the second cell comprises q pixels, wherein p and q are positive integers.

3. The method of claim 2, wherein for each two adjacent rows of display units, all the first cells of a first row of display units and all the first cells of a second row of display units interlace with each other in columns; and all the second cells of the first row of display units and all the second cells of the second row of display units interlace with each other in columns.

4. The method of claim 1, wherein when the display unit comprises n columns of pixels, each third portion of display units comprises k third cells, each fourth portion of display units comprises l fourth cells, and the third cells alternate with the fourth cells, wherein k and l are positive integers, and wherein the third cell comprises r pixels, and the fourth cell comprises s pixels, wherein r and s are positive integers.

5. The method of claim 4, wherein for each two adjacent columns of display units, all the third cells of a first column of display units and all the third cells of a second column of display units interlace with each other in rows, and all the fourth cells of the first column of display units and all the fourth cells of the second column of display units interlace with each other in rows.

6. The method of claim 4, wherein each pixel is electrically connected to a driving integrated circuit (IC) through an enable line and electrically connected to a data line through a switch, and wherein said controlling the display to alternately update display data corresponding to the third portion and the fourth portion of display units when the display unit comprises n columns of pixels comprises:

controlling, by the driving IC, switches of all of the pixels of each of the third cells to be in a first state and switches of all of the pixels of each of the fourth cells to be in a second state at an odd numbered update; and controlling, by the driving IC, the switches of all of the pixels of each of the third cells to be in the second state and controlling the switches of all of the pixels of each of the fourth cells to be in the first state at an even numbered update.

7. A device, comprising:

a display;

a processor; and a memory to store instructions executable by the processor;

wherein, the processor is configured to:

detect whether there is any change in a displayed content for the display;

in response to detecting that the displayed content for the display does not change, control the display to alternately update display data corresponding to a first portion and a second portion of display units in each row when the display unit comprises m rows of pixels; and in response to detecting that the displayed content for the display does not change, control the display to alternately update display data corresponding to a third portion and a fourth portion of display units in each column when the display unit comprises n columns of pixels, wherein m and n are positive integers, wherein each pixel is electrically connected to a driving integrated circuit (IC) through an enable line and electrically connected to a data line through a switch, and wherein the processor is further configured to:

control, by the driving IC, switches of all of the pixels of each of the first cells to be in a first state and switches of all of the pixels of each of the second cells to be in a second state at an odd numbered update; and control, by the driving IC, the switches of all of the pixels of each of the first cells to be in the second state and the switches of all of the pixels of each of the second cells to be in the first state at an even numbered update.

8. The device of claim 7, wherein when the display unit comprises m rows of pixels, the first portion of the display units comprises i first cells, the second portion of the display units comprises j second cells, and the first cells alternate with the second cells, wherein i and j are positive integers; and wherein the first cell comprises p pixels, and the second cell comprises q pixels, wherein p and q are positive integers.

9. The device of claim 8, wherein for each two adjacent rows of display units, all the first cells of a first row of display units and all the first cells of a second row of display units interlace with each other in columns; and all the second cells of the first row of display units and all the second cells of the second row of display units interlace with each other in columns.

10. The device of claim 7, wherein when the display unit comprises n columns of pixels, each third portion of display units comprises k third cells, each fourth portion of display units comprises l fourth cells, and the third cells alternate with the fourth cells, wherein k and l are positive integers, and wherein the third cell comprises r pixels, and the fourth cell comprises s pixels, wherein r and s are positive integers.

11. The device of claim 10, wherein for each two adjacent columns of display units, all the third cells of a first column of display units and all the third cells of a second column of display units interlace with each other in rows, and all the fourth cells of the first column of display units and all the fourth cells of the second column of display units interlace with each other in rows.

12. The device of claim 10, wherein each pixel is electrically connected to a driving integrated circuit (IC) through an enable line and electrically connected to a data line through a switch, and wherein the processor is further configured to:

control, by the driving IC, switches of all of the pixels of each of the third cells to be in a first state and switches of all of the pixels of each of the fourth cells to be in a second state at an odd numbered update; and control, by the driving IC, the switches of all of the pixels of each of the third cells to be in the second state and controlling the switches of all of the pixels of each of the fourth cells to be in the first state at an even numbered update.

13. A non-transitory computer-readable storage medium having stored therein instructions that, when executed by a processor of a device configured with a display, causes the device to perform a display method, the method comprising:

detecting whether there is any change in a displayed content for the display;

in response to detecting that the displayed content for the display does not change, controlling the display to alternately update display data corresponding to a first portion and a second portion of display units in each row when the display unit comprises m rows of pixels; and in response to detecting that the displayed content for the display does not change, controlling the display to alternately update display data corresponding to a third portion and a fourth portion of display units in each column when the display unit comprises n columns of pixels, wherein m and n are positive integers, wherein each pixel is electrically connected to a driving integrated circuit (IC) through an enable line and electrically connected to a data line through a switch, and wherein the processor is further configured to:

control, by the driving IC, switches of all of the pixels of each of the first cells to be in a first state and switches of all of the pixels of each of the second cells to be in a second state at an odd numbered update; and control, by the driving IC, the switches of all of the pixels of each of the first cells to be in the second state and the switches of all of the pixels of each of the second cells to be in the first state at an even numbered update.

* * * * *